US007794379B2

(12) United States Patent
Diehr et al.

(10) Patent No.: US 7,794,379 B2
(45) Date of Patent: Sep. 14, 2010

(54) FOLDED BOX GLUING MACHINE FOR PRODUCTION OF FOLDED BOXES FROM BLANKS

(75) Inventors: Wolfgang Diehr, Grevenbroich (DE); Carsten Terhorst, Hamminkeln (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 0 days.

(21) Appl. No.: 11/876,588

(22) Filed: Oct. 22, 2007

(65) Prior Publication Data

US 2008/0108489 A1 May 8, 2008

(30) Foreign Application Priority Data

Nov. 8, 2006 (DE) ..... 10 2006 052 647

(51) Int. Cl.
*B31B 1/88* (2006.01)

(52) U.S. Cl. ..... 493/55; 493/58; 493/160

(58) Field of Classification Search ..... 493/59, 493/58, 55, 143, 144, 145, 146, 160
See application file for complete search history.

(56) References Cited

U.S. PATENT DOCUMENTS

| | | | | |
|---|---|---|---|---|
| 1,983,323 | A * | 12/1934 | Stokes | 493/55 |
| 2,472,883 | A | 6/1949 | Bergstein | |
| 4,261,663 | A * | 4/1981 | Grimnes | 400/109.1 |
| 4,425,106 | A * | 1/1984 | Boegli et al. | 493/45 |
| 4,653,942 | A * | 3/1987 | Soloveychik et al. | 400/109.1 |
| 5,193,921 | A * | 3/1993 | Tsukuda et al. | 400/109.1 |
| 5,384,177 | A * | 1/1995 | Rissmann | 428/182 |
| 5,702,559 | A * | 12/1997 | Bright | 156/450 |
| 5,753,350 | A * | 5/1998 | Bright | 428/195.1 |
| 6,095,959 | A * | 8/2000 | Negrini et al. | 493/58 |
| 6,368,539 | B1 * | 4/2002 | Greenfield et al. | 264/284 |
| 6,419,079 | B1 | 7/2002 | Diehr | |
| 6,537,189 | B1 * | 3/2003 | Gehle | 493/396 |
| 2004/0224828 | A1 | 11/2004 | Nelles | |
| 2005/0119099 | A1 | 6/2005 | Madern | |
| 2006/0040816 | A1 | 2/2006 | Gordon | |

FOREIGN PATENT DOCUMENTS

| | | | |
|---|---|---|---|
| CA | 1 195 162 | A | 10/1985 |
| DE | 2 061 973 | | 9/1971 |
| DE | 31 24 344 | A1 | 1/1983 |
| DE | 32 22 017 | A1 | 12/1983 |
| DE | 20 2005 017 869 | U1 | 7/2006 |
| EP | 1 640 938 | A1 | 3/2006 |
| EP | 1 820 632 | A1 | 8/2007 |
| GB | 1 598 183 | | 9/1981 |
| JP | 2001-105512 | A | 4/2001 |

OTHER PUBLICATIONS

Official communication issued in counterpart European Application No. 07117763.8, mailed on Jan. 15, 2008.
Official communication issued in the German Application No. DE 10 2006 052 647.3, mailed on Jun. 26, 2007.

* cited by examiner

*Primary Examiner*—Sameh H. Tawfik
(74) *Attorney, Agent, or Firm*—Keating & Bennett, LLP

(57) ABSTRACT

A folded box gluing machine for making folded boxes from blanks includes several processing stations and a conveying mechanism for delivering the blanks through the individual processing stations. The machine also includes an embossing mechanism that includes embossing dies for embossing a script for the blind in the blanks and that is preferably arranged between two processing stations.

11 Claims, 4 Drawing Sheets

7

8

FOLDED BOX GLUING MACHINE FOR PRODUCTION OF FOLDED BOXES FROM BLANKS

BACKGROUND OF THE INVENTION

1. Field of the Invention

The present invention concerns a folded box gluing machine for making folded boxes from blanks, having several processing stations and a conveying mechanism for delivering the blanks through the individual processing stations.

2. Description of the Related Art

Folded boxes are packages of cardboard or corrugated carton, also made from plastic on a small scale, which depending on their design, are glued in one or more places during the folding process. As a rule, the folded boxes are produced from a blank. The blanks are usually punched out on a sheet punch. The blank must be glued on at least one edge. The folded boxes come from the folded box gluing machine in a condition lying flat. The setting up and filling of the boxes can be done by machine or also manually.

Besides the folded seams, which are necessary to make the folded boxes, additional crease lines are also pre-broken (pre-folded) in the folded box gluing machine as preparation for the next production step. In this way, the setting up of the boxes and the later filling is facilitated.

The actual gluing process is only one part of the complex mechanical process in the making of folded boxes. Depending on the kind of box, various folds have to be made in and transverse to the direction of movement of the machine before the glue is applied in order to prepare the folded box for setting up and to apply the glue to the correct place.

Folded box gluing machines for making folded boxes from blanks have several processing stations through which the blanks of the folded boxes move in succession, which are described below.

Feeder

The box blanks are placed between two sideways adjustable stack walls at the feeder. Each time, the lowermost blank is pulled into the machine by revolving feed belts. Thanks to height-adjustable positioning tongues, double feeding can be prevented. As a result, an optimal pulling of the blanks with no marring is assured. The feeder singles out the blanks and ensures a definite distance between the blanks.

Orienting Station

In order to orient the blanks exactly with crease lines parallel to the transport direction for the following folding process, it is known how to arrange a so-called orienting station directly behind the feeder. The orienting of the blanks occurs on a guide strip, which extends in the transport direction, and the blanks are moved sideways against it.

Pre-Breaker

In the pre-breaker, the crease lines are pre-broken and then passed on, lying flat again, to the following station. Thanks to the pre-breaking (folding back and forth) of the crease lines, they are made soft and flexible. In this way, glued boxes can be opened more easily, and their filling is simplified. The pre-breaker also makes it possible to add on accessories.

Folding Station

Here, the blanks are folded and glued. The bottom gluing unit at the start of the station enables a precise glue application and low-spray operation, even at the highest production speeds.

Transfer Station

The glued boxes are prepared in the station for peeling off and transfer to the pressing station. When code readers or glue application checking are used, defective boxes can be taken out of line at the transfer station by an accessory device. At this station, the boxes are counted, and individual boxes are set down with a sideways offset by a marking device. In this way, the stream of boxes is optimally prepared for a fast and easy manual pick-up.

Collecting and Pressing Unit

In the slower-running pressing station, the peeled-off boxes are taken, under precisely adjustable pressure, between revolving press belts, to give the glue time to set even at high production speeds. For this, folded box gluing machines can be outfitted with an electronic mechanism to control the speed for the collecting and pressing unit, depending on the blanks. This automatically ensures the precise peeling rate and thus a uniform pressing of the boxes even when the stream of boxes is changing.

Accessory Machines

The option exists of installing semiautomatic or fully automatic packing machines after the collecting and pressing unit. The glued boxes are then packed by machine directly into larger boxes and made ready for an easier handling. In addition, at the feeder of a folded box gluing machine there can also be connected a pre-feeder for supplying an uninterrupted stream of folded box blanks.

With the option of a pre-feeder and a packing machine at the folded box gluing machine, a comprehensive fully automatic system is provided for highest production performance and product quality so as to provide a highly economical system, exactly tailored to the needs of the professional user. Furthermore, glue application and checking devices, glue nozzle units (for cold and hot glue), and code readers and glue application checkers can be integrated.

The transport of the blanks through the individual processing stations occurs by upper and lower conveying belts, which are each supported at their side a location spaced away from the blanks. As a rule, two pairs of narrow belts are used across the width of the machine, and they can be positioned crosswise to adjust to different box formats for an optimal line of contact with the blanks. Position displays for adjusting the roller bars to the format enables brief setup times for adjustments and repeat production runs. The upper roller bars can be lifted. This simplifies the adjustment work and reduces setup time. Furthermore, the blanks can easily be taken out.

Such folded box gluing machines are known, for example, from EP 10 01 877 B1.

If the folded boxes are used to pack pharmaceuticals, it is mandated by law to affix (e.g., by embossing) the name of the drug in script for the blind (so-called Braille script) on the folded box. For this, a technical guideline "Script for the blind in the production of folded boxes" has been issued by the Folded Box Industrial Association to serve as a guide for the standardized production of script for the blind on folded boxes.

As is known, the embossing of the script for the blind occurs during the punching process at the sheet punch when the blanks are produced. But this is costly, since a punched sheet contains quite a few copies (blanks) and each copy needs a pair of dies consisting of male and female dies. Thus, very high tooling costs arise. Furthermore, it has been found that the punched sheets have a tendency to get stuck on the embossing dies for the Braille script and thus impair the punching process. Moreover, it is difficult to emboss the crease lines and the Braille script at the same time, if the Braille script is located near the crease lines. The dies for the embossing of the crease lines and the Braille script need to have a minimum spacing from each other. What is more, the necessary adjustment time is increased because of the many dies in the punching form.

SUMMARY OF THE INVENTION

Thus, in order to overcome the problems described above, preferred embodiments of the present invention enable the embossing of a script for the blind in a folded box in a simplified form and without impairing the other processing steps during the making of a folded box.

According to a preferred embodiment of the present invention, an embossing mechanism includes embossing dies for embossing of a script for the blind into the blanks arranged in the folded box gluing machine, the embossing dies being preferably located between two processing stations.

Other features, elements, processes, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
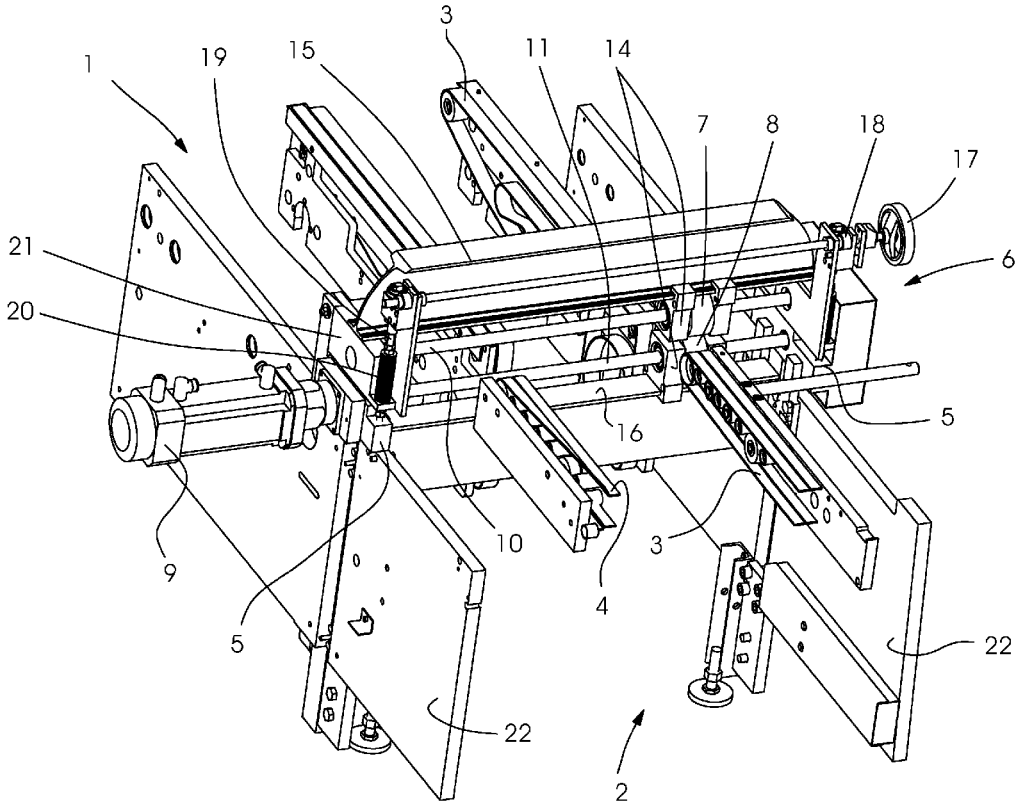
FIG. 1 shows in perspective view a portion of a folded box gluing machine with the embossing mechanism for a script for the blind.

The folded box gluing machine, only a cutout of which is shown in the figures, preferably includes the usual work stations as described above, of which only the orienting station and pre-breaker station are shown in detail. A feeder, not shown, pulls the blanks at high speed off of a stack, one after the other, so that they are fed individually to the following processing stations. After the feeder comes an orienting station 1, which is shown partially in the figures along with the following pre-breaker station 2. As is known, the orienting station serves for an exact orienting of the blanks, so that after the orienting the crease lines run exactly in the transport direction. For this, the orienting station 1 preferably includes a guide rail, oriented exactly in the transport direction of the blanks, against which the blanks are guided and thus oriented. After the orienting station 1 comes a pre-breaker station 2, which contains folding elements, in order to fold the flaps of the blanks back and forth, so that the corresponding lengthwise crease lines are made soft and flexible by bending through 180°, for example. After the pre-breaker 2, the next processing station is a folding station, not shown.

The conveying device for delivering the blanks through the individual processing stations preferably includes two pairs of belts 3, 4, which are made up of individual segments corresponding to the individual processing stations. Each of the pairs of belts 3, 4 of a segment, including an upper and a lower conveying belt, is mounted on the machine and able to be positioned crosswise in the frame 22 to adjust the optimal position of attack for the changing blank formats. Between two processing stations 1, 2, a short gap is formed between the pairs of conveying belts 3, 4, where portions of the blanks are freely accessible and can thus be grasped with processing tools.

According to a preferred embodiment of the present invention, an embossing mechanism with embossing dies for the embossing of a script for the blind in the blanks is arranged in the folded box gluing machine. Preferably, the embossing mechanism is arranged between two processing stations 1, 2 in a region where a gap exists between two pairs of conveying belts 3, 4, so that a portion of the blanks lies free. The embossing dies engage with the free lying region.

Figure 4:
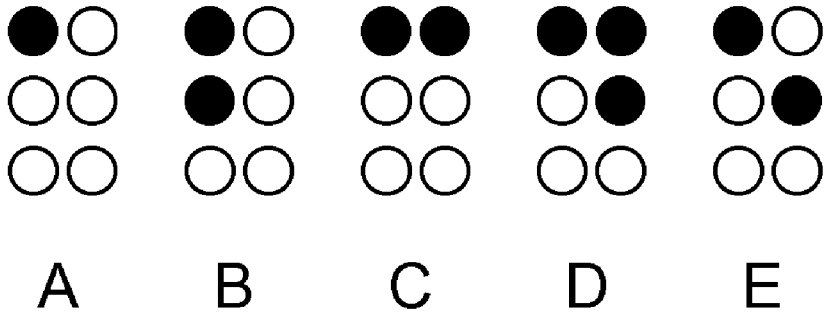
FIG. 4 is a schematic view of upper embossing dies for embossing Braille script that include a product-specific male mold.
Figure 5:
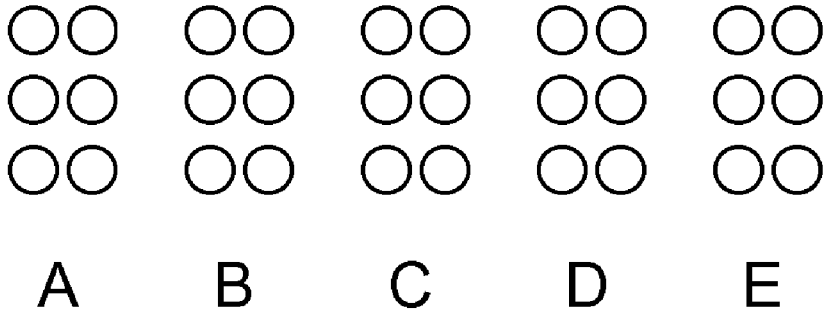
FIG. 5 is a schematic view of lower embossing dies for embossing Braille script that include a product-neutral female mold.

Advantageously, the embossing mechanism is arranged in the front portion of the folded box gluing machine, even before the first folding station. Since no parts of the blank have yet been folded prior to the first folding station, the script for the blind can be embossed at any position across the width of the blank. Preferably, the embossing mechanism is arranged between the orienting station 1 and the pre-breaker station 2, as shown in the figures. The embossing mechanism 6 is configured as a rotational embossing mechanism and preferably includes a rotating driven upper die 7, coordinated with a likewise rotating driven lower die 8. Since the printed side of the blank lies underneath during the manufacture of the box and the embossing of the Braille script has to be done on the outside, the upper die 7 is outfitted with a male mold individually for each product, as shown in FIG. 4. The lower die 8 preferably includes a product-neutral female mold, as shown in FIG. 5, which acts as a counter-mold. In this way, the dots of the Braille script are embossed from the top downward through the material of the blank. FIG. 4 shows a schematic example of an upper die 7 that includes product-specific male molds for letters A to E. Each of letters A to E is represented by a matrix of six cells that includes a particular arrangement of raised dots (shown as black dots in FIG. 4). FIG. 5 shows schematic example of a lower die 8 that includes product-neutral female molds, none of which include any raised dots.

Both the upper die 7 and the lower die 8 preferably are connected to a rotation drive, a servomotor 9 in the present preferred embodiment. The servomotor 9 is fastened on a side plate 5 of the mechanism. It drives two drive shafts 10, 11 which extend across the entire width of the folded box gluing machine and are each mounted at their end in the side plates of the mechanism 5. The drive shaft 10 goes through the upper die 7, the drive shaft 11 through the lower die 8, while the dies 7, 8 can be shifted freely on their respective drive shafts 10, 11 for a crosswise positioning. In the present preferred embodiment, the drive shaft 11 of the lower die 8 is connected directly to the servomotor 9. The drive shaft 10 of the upper die 7 is driven by synchronous disks 12 and a double-toothed belt 13 arranged on the drive shafts 10, 11. The double-toothed belt 13 guarantees a synchronous rotation of upper and lower die 7, 8.

Alternatively, the lower embossing die 8 can also be coupled with the drive of the conveying mechanism 3, 4, and the upper embossing die 7 can be provided with a rotation drive.

Figure 2:
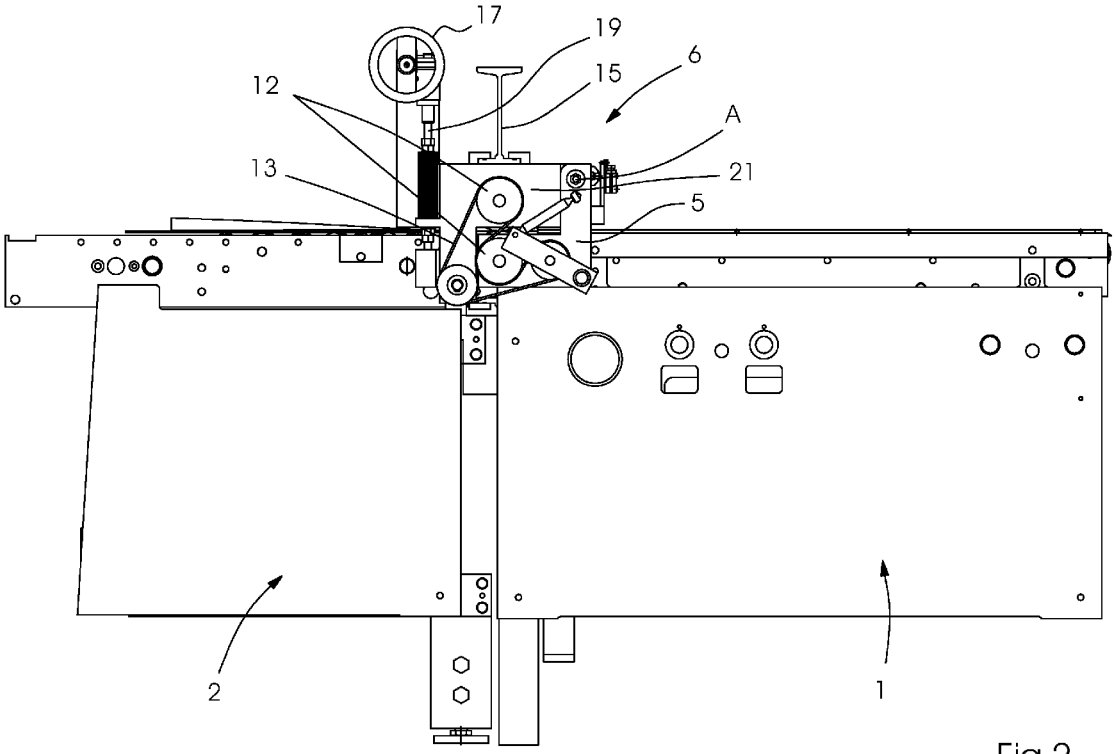
FIG. 2 shows the side view of the portion of the folded box gluing machine.
Figure 3:
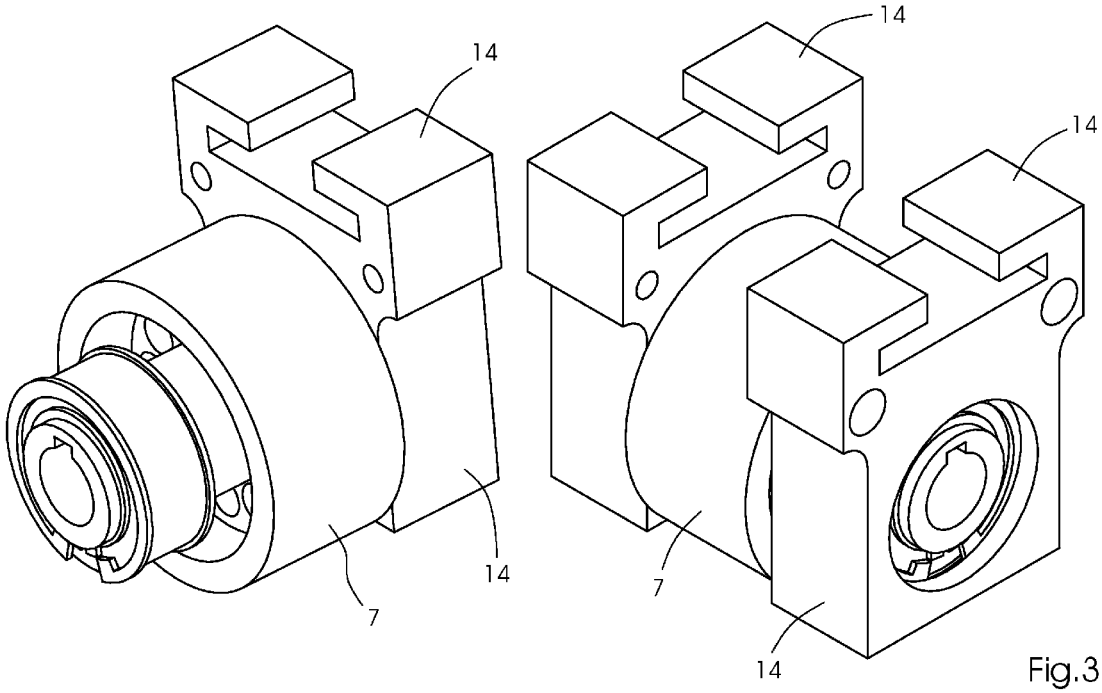
FIG. 3 shows in magnified view a rotating embossing die and its mounting.

To absorb the embossing forces, both the upper die 7 and the lower die 8 are mounted in bearing blocks 14, with the bearing blocks 14 of the upper dies 7 being supported on an upper cross beam 15 and being guided by this. The bearing blocks 14 of the lower dies 8 are supported by a lower cross beam 16 and are guided by this. The bearing blocks 14 with the dies 7, 8 fastened to them can be positioned continuously perpendicular to the transport direction and thus across the working width of the machine and are fixed in their working position by screws or other fixing members. While the lower cross beam 16 is screwed by its ends to the walls of the machine frame 22 and thus fixed in position, the upper cross beam 15 is mounted on swivel levers 21 at the sides, which can swivel about the point A (FIG. 2). Thanks to the swiveling of the upper cross beam 15, the distance of the upper die 7 from the lower die 8 can be adjusted and thus adapted to the material thickness of the blanks. The adjustments of the distance preferably are done manually by a hand wheel 17 whose turning motion is transformed by a worm gear 18 into the vertical movement of a spindle 19. The vertical motion of the spindle 19 brings about a swiveling of the cross beam about the point A and thus a change in the distance of the upper die 7 from the lower die 8. The spindle 19 engages the swivel lever 21 preferably via a spring washer stack. The spring stack ensures that the upper die 7 can move upwards if several blanks one on top of another come in. The cross beam 15 with the upper die 7 mounted on it is thus mounted with no rigid mechanical linkage, but elastically supported by the spring stack. In order for the two swivel levers 21 to move in parallel on each side of the machine, they are linked together by a torsion shaft, acting as a synchronous shaft.

All parts of the embossing mechanism 6 are directly or indirectly mounted in side plates 5, each of which lie against the walls of the machine frame 22 and are secured to it preferably via fastening screws or other fastening elements. Thus, by loosening the fastening screws, the embossing mechanism 6 can be removed as a whole from the folded box gluing machine.

The blanks are transported by the pairs of belts 3, 4 from the feeder to the orienting station 1. Here, they are oriented and taken up to the embossing dies 7, 8. A light scanner (not shown) arranged in front of the embossing dies 7, 8 recognizes a blank coming into the embossing mechanism 6 and triggers the rotational movement of the dies 7, 8. The servomotor 9 accelerates the dies 7, 8 to a circumferential speed corresponding to the delivery speed of the belt pairs 3, 4. This delivery speed is determined by a tachometer arranged in the machine. Thus, the dies 7, 8 emboss the Braille script in the particular blank as it moves through, without any relative speed to the further transported blank. The embossed blanks are then delivered to the pre-breaker station 2 and then run through the further processing stations of the folded box gluing machine.

The present preferred embodiment of the present invention achieves a major benefit that only one pair of embossing dies per product is needed. The embossing of the Braille script can be applied to the blanks independently of the crease lines. The orienting station 1 arranged before the embossing mechanism 6 in the delivery direction guarantees an exact positioning of the Braille script on the blank.

The embossing dies 7, 8 are mounted in the respective cross beams 15, 16 and can be positioned crosswise, so that the Braille script can be embossed at the desired position of the blank. In the described sample preferred embodiment, the positioning of the dies 7, 8 preferably occurs manually or by operating a manual crank before the folded box gluing machine commences its production. For an automatic positioning, it is possible to connect the bearing blocks 14 of the dies 7, 8 to spindles, each of them driven by a spindle motor.

If the embossing mechanism 6 is supposed to be moved into an inactive position within the folded box gluing machine for a production without Braille script, the embossing mechanism 6 is fastened to a side swivel arm, which is fastened to the wall of the frame 22 so that it can swivel. For a movement into an inactive position, the entire device is then swiveled upward. Alternatively, it is possible to mount the embossing mechanism 6 on vertical columns at the sides, which are fastened to the frame walls. In this case, the embossing mechanism 6 is moved upward vertically on the columns for movement into an inactive position.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A folded box gluing machine for making folded boxes from blanks comprising:

an orienting station arranged to orient and guide the blanks;

a pre-breaker station arranged adjacent to the orienting station with a gap therebetween and arranged to fold flaps of the blanks back and forth;

a conveying mechanism arranged to deliver the blanks through the orienting station and the pre-breaker station; and an embossing mechanism including embossing dies arranged in the gap between the orienting station and the pre-breaker station so as to emboss the blanks; wherein one of the embossing dies includes a product-specific male mold and another die includes a product-neutral female mold; and the product-specific male mold and the product-neutral female mold define dots of Braille script.

2. The folded box gluing machine according to claim 1, wherein the embossing mechanism is a rotational embossing mechanism including rotating embossing dies.

3. The folded box gluing machine according to claim 2, wherein the embossing dies have a common rotation drive.

4. The folded box gluing machine according to claim 2, wherein a lower embossing die is coupled to a drive of the conveying mechanism and an upper embossing die includes a rotation drive.

5. The folded box gluing machine according to claim 1, wherein the product-neutral female mold is interchangeable.

6. The folded box gluing machine according to claim 1, wherein the embossing dies are mounted in the machine and can be positioned in a crosswise direction.

7. The folded box gluing machine according to claim 1, wherein the product-specific male mold is interchangeable.

8. The folded box gluing machine according to claim 1, wherein positions of the embossing dies are adjustable relative to each other.

9. The folded box gluing machine according to claim 1, wherein the embossing mechanism is arranged in front of a first folding station.

10. The folded box gluing machine according to claim 1, wherein the embossing mechanism is arranged to be removed from the machine.

11. The folded box gluing machine according to claim 10, wherein the embossing mechanism is arranged to swivel in the machine from an active position to an inactive position.

* * * * *